US005676908A

United States Patent [19]

Kubbutat et al.

[11] Patent Number: 5,676,908

[45] Date of Patent: Oct. 14, 1997

[54] PLATE FOR COOLING SHAFT FURNACES

[75] Inventors: Axel Kubbutat; Werner Otremba, both of Oberhausen; Karl Spickermann, Dorsten, all of Germany

[73] Assignee: Man Gutenoffungshutte Aktiengesellschaft, Germany

[21] Appl. No.: 568,947

[22] Filed: Dec. 7, 1995

[30] Foreign Application Priority Data

Feb. 7, 1995 [DE] Germany ..... 195 03 912.2

[51] Int. Cl.[6] ..... C21B 7/10

[52] U.S. Cl. ..... 266/193; 266/197

[58] Field of Search ..... 266/193, 199, 266/197, 192

[56] References Cited

U.S. PATENT DOCUMENTS

| | | | |
|---|---|---|---|
| 3,881,860 | 5/1975 | Brandenburg | 266/193 |
| 3,953,008 | 4/1976 | Bashinsky et al. | 266/193 |
| 3,984,089 | 10/1976 | Van Laar et al. | 266/193 |

FOREIGN PATENT DOCUMENTS

| | | | |
|---|---|---|---|
| 312876 | 11/1971 | U.S.S.R. | 266/193 |
| 1035069 | 8/1983 | U.S.S.R. | 266/193 |

*Primary Examiner*—Scott Kastler

[57] ABSTRACT

The present invention concerns a plate (1) for cooling a blast furnace and forged or rolled out of a blank of copper or mainly-copper alloy.

Vertical bores (3) extend into the plate. A detachable furnace-cooling component (4) with vertical bores (5) and horizontal bores (6) extending into it is attached to the top or bottom of the plate.

Coolant is pumped into and out of the bores in the furnace-cooling component through sections (2) of pipe and into and out of the bores in the plate through other sections (2) of pipe. Both cooling systems communicate with the furnace's cooling system by way of the pipe sections (2), which extend through the furnace plating (10).

6 Claims, 3 Drawing Sheets

PLATE FOR COOLING SHAFT FURNACES

BACKGROUND OF THE INVENTION

The present invention concerns a plate for cooling shaft furnaces, especially blast furnaces, that have refractory linings. The plate is made of copper or a mainly-copper alloy and accommodates coolant channels. The plate is forged or rolled out of a blank, and the channels are vertical bores that extend into it.

Plates of this genus are usually interposed between the wall of the furnace and its lining and communicate with its cooling system. The surface of the cooling component facing the interior of the furnace is partly lined with a refractory material.

A furnace-cooling plate is known from German 3 925 280. The channels are in the form of pipes embedded in an iron casting. The lower edge of the plate acts as a projection for supporting the refractory lining. That projection also communicates with the cooling system. Such plates can divert little heat due to the poor heat conductivity of the iron and to an impedance between the tubes and the plate deriving from a layer of oxide or air gap.

When the furnace's lining wears out after long use, the inner surface of the furnace-cooling plate will be directly exposed to the heat inside the furnace. Since the temperature of the furnace is far above the melting point of the iron and since the plate's internal heat impedance is detrimental to cooling the hot surface of the plate, accelerated wear of the cast-iron plates is unavoidable, and its life is accordingly curtailed.

Furnace-cooling plates of cast copper are also known. Their cooling channels are either embedded pipes or part of the casting itself. The structure of cast copper is not as homogeneous and dense as that of forged or rolled copper. Cast copper accordingly conducts less heat and is not as strong. Furthermore, the oxide coating between the pipe and the rest of the plate impedes the heat conductivity of the embedded pipes.

A furnace-cooling plate is known from German 2 907 511. It is forged or rolled out of a blank. The channels are vertical bores drilled into it. The structure of the plate is essentially denser and more homogeneous than that of a cast-copper plate. It has none of the blowholes or bubbles characteristic of cast plates. The plate is stronger and conducts more heat more uniformly than cast-copper plates do. The bores are precisely where they should be vertically and horizontally, ensuring uniform heat diversion.

The surface of the plate facing the inside of the furnace is lined with refractory brick or monolith, diminishing the plate's active cooling area. How much heat can be extracted from the furnace when the refractory lining wears out or is lost will accordingly be limited. The plate will also need to be cooled thoroughly enough to maintain the temperature of the hot side of the plate well below the copper's softening point.

A furnace-cooling plate forged or rolled out of a copper blank is known from the as yet unpublished European Patent 94 115 821.4. Channels are introduced in addition to the vertical bores to cool the edges. The channels are thinner vertical or horizontal bores bored into the edges around the vertical bores.

There is a drawback to these forged or rolled copper plates, however, in that the supporting capacity of the lining or intermediate lining at the head ends of the plate is not ideal, so that the life of the refractory brick or monolith is not long enough. cl SUMMARY OF THE INVENTION The object of the present invention is accordingly a furnace-cooling plate with reinforced head ends integrated into the cooling system wherein heat will be uniformly and homogeneously diverted in that area of the plates as well, so that improved cooling of the refractory furnace lining will be ensured there as well.

This object is attained in accordance with the present invention as recited in the major claim. Further advantageous embodiments of the present invention are recited in the subsidiary claims.

An additional, detachable, cooling component is accordingly introduced at the top or bottom of the forged or rolled copper furnace-cooling plate with vertical and horizontal bores extending into it. The vertical and horizontal bores are sealed tight at the end by a known procedure with welded or soldered plugs and communicate with the furnace's cooling system through tubular copper connectors.

Instead of a detachable cooling component, a bead can be forged for the refractory lining out of the copper blank, with the vertical and horizontal cooling pipes conventionally bored into the bead.

BRIEF DESCRIPTION OF THE DRAWINGS

The present invention will now be specified with reference to the accompanying drawing, wherein.

DESCRIPTION OF THE PREFERRED EMBODIMENTS

Figure 1:
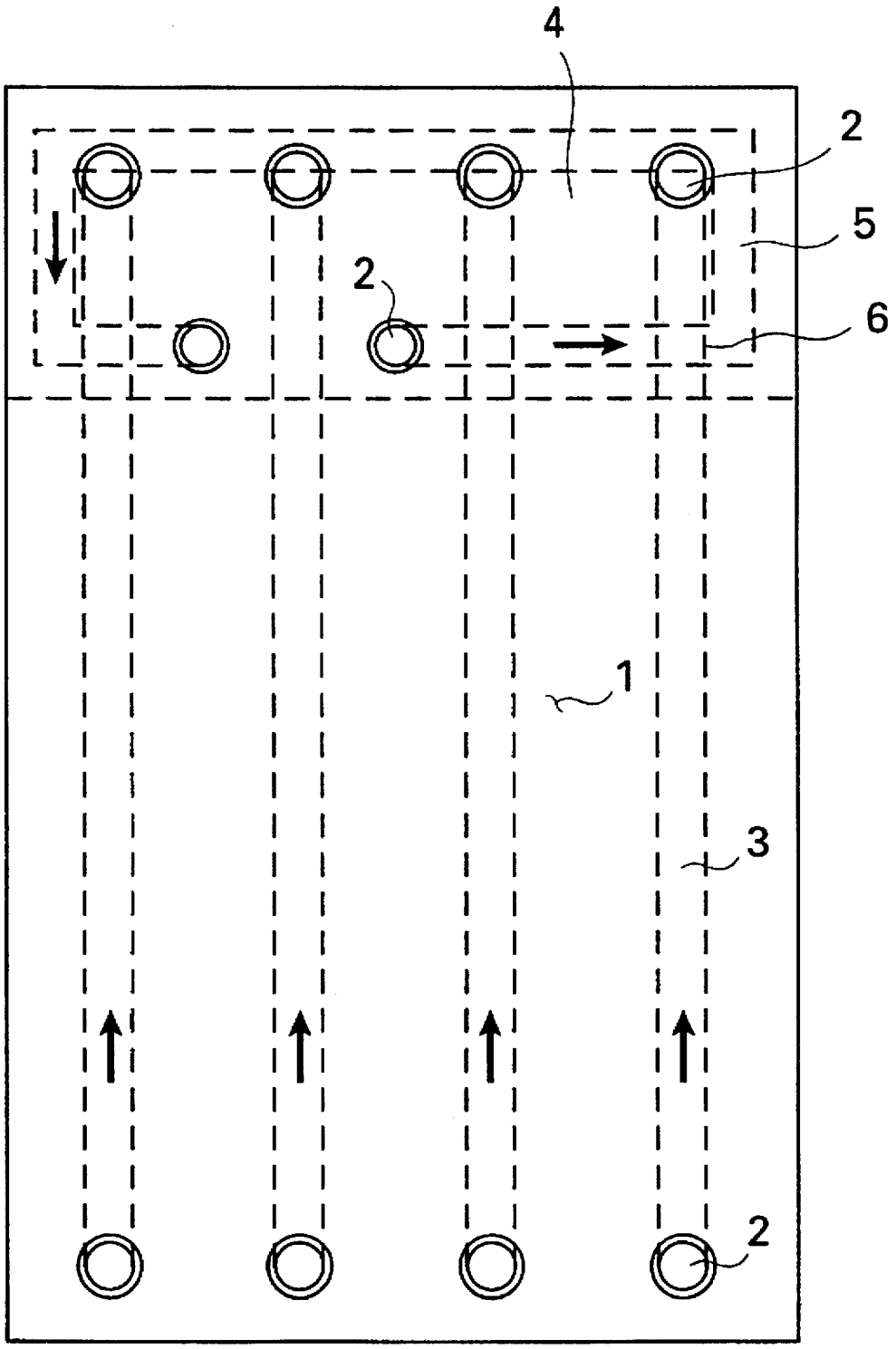
FIG. 1 is a longitudinal section through a furnace-cooling plate.

FIG. 1 is a longitudinal section through a furnace-cooling plate 1 with four for example vertical bores 2 [sic!] and 3 extending into it and with vertical bores 5 and horizontal bores 6 extending into a cooling component 4.

A coolant in the form of water is introduced into bores 3 from below through sections 2 of pipe that communicate with supply lines and into vertical and horizontal bores 5 and 6 through other sections 2 of pipe. The systems that circulate the coolant through the plate 1 and cooling component 4 are separately connected to the system that supplies coolant to the furnace.

Figure 2:
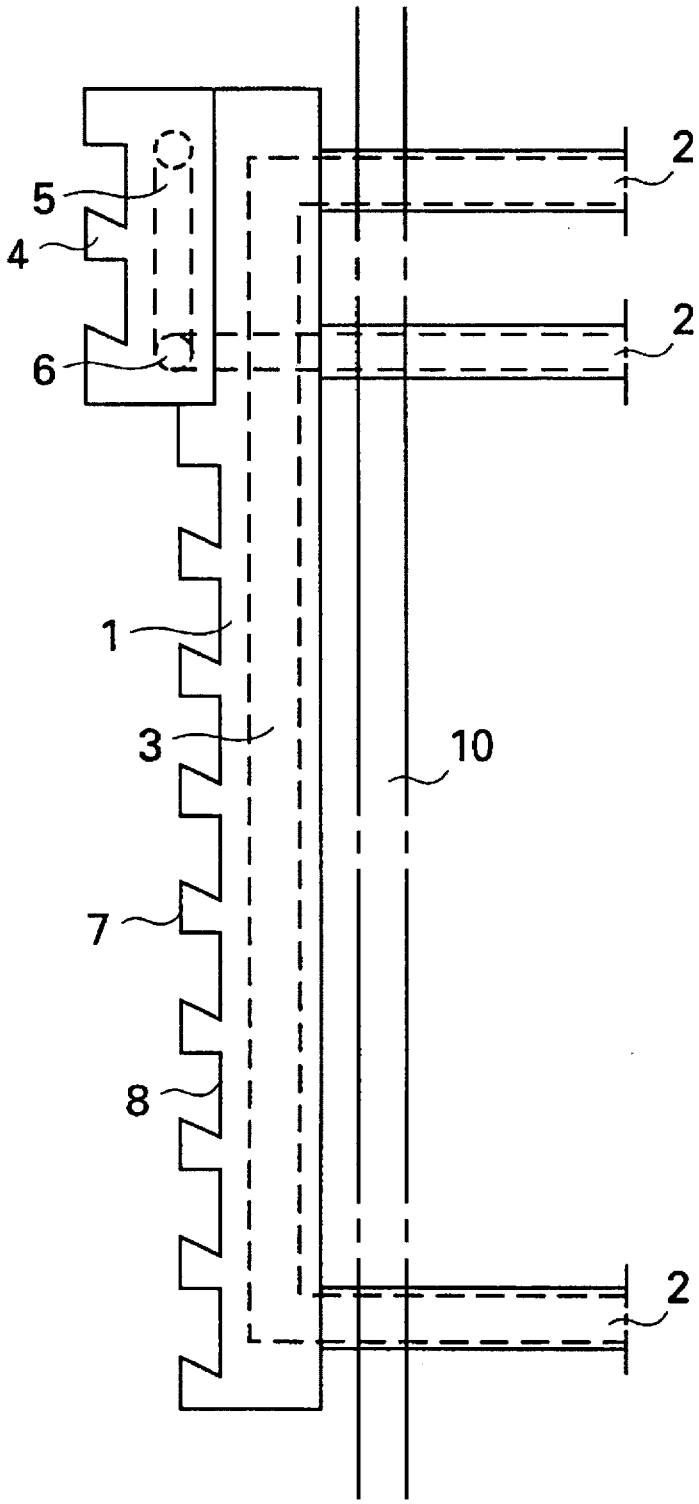
FIG. 2 is a transverse section through a furnace-cooling plate with a detachable cooling component.

FIG. 2 is a section through plate 1 with vertical bores 3 extending into it and sealed off by a known procedure at the bottom by welding or soldering. The water is pumped in and out through pipe sections 2.

At the top of furnace-cooling plate 1 is a detachable cooling segment 4 with vertical bores 5 and horizontal bores 6 extending into it. More horizontal bores 6 also extend into plate 1 itself in order to allow water to be pumped in and out through the wall of furnace plating 10 through pipe sections 2.

The refractory material, whether brick or monolith, is secured in place by grooves 8 in the sides of furnace-cooling plate 1 and cooling component 4 that face the inside of the furnace. Grooves 8 are demarcated by webs 7.

Figure 3:
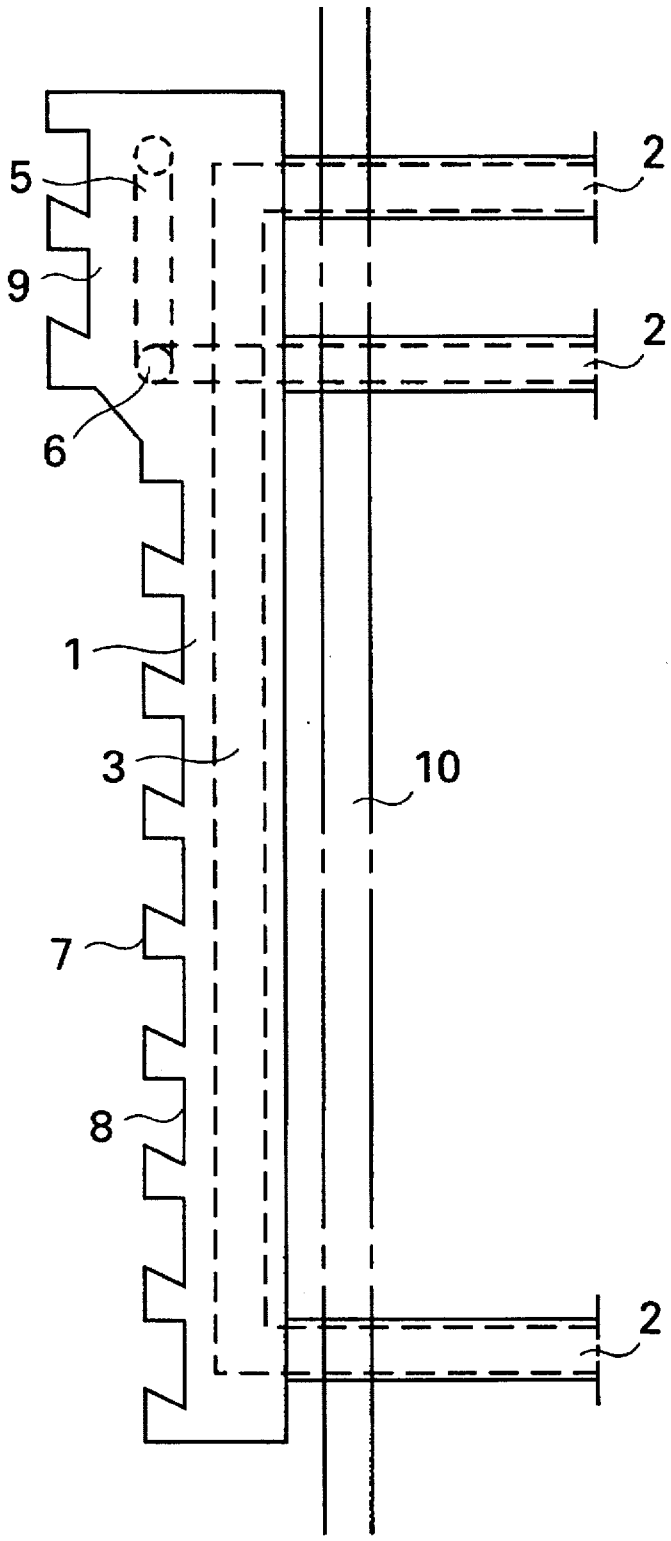
FIG. 3 is a transverse section through a furnace-cooling plate with a bead forged out of it.

FIG. 3 illustrates a plate 1 with a bead 9 forged out of the blank. Vertical bores 5 and horizontal bores 6 extend into bead 9. Here as well, horizontal bores 6 communicate with the furnace's cooling system through the wall of furnace plating 10 by way of pipe sections 2.

We claim:

1. A plate for cooling shaft furnaces in form of blast furnaces having refractory linings, comprising: a plate made of at least copper; coolant channels in said plate free of steel and copper piping, said plate being forged or rolled out of a blank; and channels bored into said plate after being forged or rolled, said channels being vertical bores extending into said plate; a furnace-cooling segment having a horizontal bore and being attachable to and detachable from said plate; said segment having vertical bores and horizontal bores for connecting to a cooling system, said vertical bores in said segment communicating at an end with said horizontal bores, said vertical bores and said horizontal bores in said segment extending in and opening into horizontal pipe sections for connecting to a cooling circuit of said shaft furnace; said bores having walls formed from said plate free of a gap between said walls and said plate; said plate having reinforced head ends integrated into said cooling system for improving cooling and heat transfer from said furnace linings, said vertical and horizontal bores in said segment being sealed tight at an end.

2. A plate for cooling shaft furnaces in form of blast furnaces having refractory linings—comprising: a plate made of at least copper; coolant channels in said plate free of steel and copper piping, said plate being forged or rolled out of a blank; said channels bored into said plate after being forged or rolled, said channels being vertical bores extending into said plate; a furnace cooling segment having a horizontal bore; webs and grooves, said segment being mounted on said cooling plate at an upper region or lower region of said cooling plate and having vertical bores and horizontal bores on a side of said webs and grooves for connecting to a cooling system; pipe sections for connecting to a cooling circuit of said furnaces, said vertical bores and said horizontal bores in said segment communicating with said pipe sections; said bores having walls formed from said plate free of a gap between said walls and said plate; said plate having reinforced head ends integrated into said cooling system for improving cooling and heat transfer from said furnace linings, said vertical and horizontal bores in said segment being sealed tight at an end.

3. A furnace-cooling plate as defined in claim 1, including webs and grooves, said furnace-cooling segment being attachable to and detachable from top or bottom of said cooling plate on a side of said webs and grooves.

4. A furnace-cooling plate as defined in claim 1, including webs and grooves, said furnace-cooling segment being attachable to and detachable from any location of said cooling plate on a side of said webs and grooves.

5. A furnace-cooling plate as defined in claim 1, wherein said furnace-cooling segment is square-shaped.

6. A furnace-cooling plate as defined in claim 1, wherein said furnace-cooling segment is rectangular-shaped.

* * * * *